US005288736A

United States Patent [19]

Schoen et al.

[11] Patent Number: 5,288,736

[45] Date of Patent: Feb. 22, 1994

[54] METHOD FOR PRODUCING REGULAR GRAIN ORIENTED ELECTRICAL STEEL USING A SINGLE STAGE COLD REDUCTION

[75] Inventors: Jerry W. Schoen, Middletown, Ohio; Francesco Gaudino, Butler, Pa.

[73] Assignee: Armco Inc., Middletown, Ohio

[21] Appl. No.: 974,772

[22] Filed: Nov. 12, 1992

[51] Int. Cl.[5] ..... H01F 1/04

[52] U.S. Cl. ..... 148/113; 148/111

[58] Field of Search ..... 148/111, 112, 113

[56] References Cited

U.S. PATENT DOCUMENTS

| | | | |
|---|---|---|---|
| 3,333,992 | 8/1967 | Kohler | 148/113 |
| 3,671,337 | 6/1972 | Kumai et al. | 148/111 |
| 3,764,406 | 10/1973 | Littmann | 148/111 |
| 3,802,937 | 4/1974 | Kohler | 148/111 |
| 3,843,422 | 10/1974 | Henke | 148/111 |
| 3,986,602 | 10/1976 | Regitz | 148/110 |
| 4,202,711 | 5/1980 | Littmann et al. | 148/111 |
| 4,493,739 | 1/1985 | Fujiwara et al. | 148/111 |
| 4,878,959 | 11/1989 | Stroble et al. | 148/111 |
| 4,938,807 | 7/1990 | Takahashi et al. | 148/111 |
| 5,061,326 | 10/1991 | Schoen | 148/12.4 |
| 5,066,343 | 11/1991 | Nakashima et al. | 148/111 |

FOREIGN PATENT DOCUMENTS

| | | | |
|---|---|---|---|
| 60-197883 | 10/1985 | Japan | 148/113 |

OTHER PUBLICATIONS

"Developments of Grain Oriented Si Steel Sheets with Low Iron Loss", Sadyori et al, Kawasaki Seitetsu Giho, vol. 21, No. 3, pp. 93-98, 1989.

*Primary Examiner*—John P. Sheehan

*Attorney, Agent, or Firm*—Larry A. Fillnow; Robert J. Bunyard; Robert H. Johnson

[57] ABSTRACT

The present invention produces a regular grain oriented electrical steel using a single cold reduction step having excellent and highly uniform magnetic quality. The method includes the steps of providing an electrical steel band having Mn of 0.024% or less in excess of that needed to combine with S and/or Se: The band is provided with an anneal at a temperature of from 900°-1125° C. (1650°-2050° F.) for a time up to 10 minutes and slowly cooled to 480°-650° C. (900°-1200° F.) followed by rapid cooling to a temperature below 100° C. (212° F.). The annealed band must have a critical amount of austenite, $\gamma_{1150° C.}$, of 7% or more. The annealed band is cold reduced in a single stage to the desired final thickness. The strip is decarburized and provided with an annealing separator coating on one or more surfaces of the strip. Before or during the final high temperature anneal, a total S level at least 15 mg per square meter is provided. The strip is final annealed at a temperature of 1100° C. or higher to effect secondary grain growth. The finished regular grain oriented electrical steel has far superior and more uniform magnetic quality than available from previous single stage processes and which magnetic quality is comparable to regular grain oriented electrical steels made using processes requiring two stages of cold reduction separated by an annealing step.

13 Claims, 3 Drawing Sheets

METHOD FOR PRODUCING REGULAR GRAIN ORIENTED ELECTRICAL STEEL USING A SINGLE STAGE COLD REDUCTION

BACKGROUND OF THE INVENTION

The production of regular grain oriented electrical steel requires critical control of all the processing steps to provide material having the desired magnetic properties which are stable and reproducible. The present invention has found a combination of processing steps which produce (110)[001] oriented electrical steel using a single stage of cold reduction while providing magnetic quality previously obtainable only with a two stage cold reduction process.

Grain oriented electrical steels are characterized by the level of magnetic properties developed, the grain growth inhibitors used and the processing steps which provide these properties. Regular or conventional grain oriented electrical steels typically have magnetic permeability below 1880 as measured at 796 A/m. High permeability grain oriented electrical steels have magnetic permeability of 1880 or above and as such are differentiated from regular grain oriented electrical steels. As taught in the prior art, regular grain oriented electrical steels are produced using manganese and sulfur (and/or selenium) as the principle grain growth inhibitor(s) with two cold reduction steps separated by an annealing step. Aluminum, antimony, boron, copper, nitrogen and other elements are sometimes present and may supplement the manganese sulfide/selenide inhibitor(s) in amounts insufficient to provide the needed level of grain growth inhibition.

Representative processes for producing regular grain oriented electrical steel are taught in U.S. Pat. Nos. 3,764,406; 3,843,422; 4,202,711 and 5,061,326 which are incorporated herein by reference. Most regular grain oriented electrical steel strip or sheet is produced using a two stage cold reduction process because it typically provides better and more uniform magnetic properties. While a single stage cold reduction process has long been sought since it eliminates at least two processing steps, the magnetic properties have not been obtainable with the same degree of consistency and quality.

Regular grain oriented electrical steel may have a mill glass film, commonly called forsterite, or an insulative coating, commonly called a secondary coating, applied over or in place of the mill glass film, or may have a secondary coating designed for punching operations where laminations free of mill glass coating are desired in order to avoid excessive die wear. Generally, magnesium oxide is applied onto the surface of the steel prior to the high temperature anneal. This primarily serves as an annealing separator coating; however, these coatings may also influence the development and stability of secondary grain growth during the final high temperature anneal and react to form the forsterite (or mill glass) coating on the steel and effect desulfurization of the base metal during annealing.

To obtain material having a high degree of cube-on-edge orientation, the material must have a structure of recrystallized grains with the desired orientation prior to the high temperature portion of the final anneal and must have grain growth inhibition to restrain primary grain growth in the final anneal until secondary grain growth occurs. Of great importance in the development of the magnetic properties of electrical steel is the vigor and completeness of secondary grain growth. This depends on having a fine dispersion of manganese sulfide or other inhibitor which is capable of restraining primary grain growth in the temperature range of 535°-925° C. (1000°-1700° F.). Thereafter, the cube-on-edge nuclei have sufficient energy to develop into large secondary crystals which grow at the expense of the less perfectly oriented matrix of primary grains. The dispersion of manganese sulfide is typically provided by high temperature slab or ingot reheating prior to hot rolling during which the fine manganese sulfide is precipitated.

The production of cube-on-edge oriented electrical steel requires that the material be heated to a temperature which dissolves the inhibitor prior to hot rolling so that during hot rolling the inhibitor is precipitated as small, uniform particles. U.S. Pat. No. 2,599,340 disclosed the basic process for the production of material from ingots and U.S. Pat. Nos. 3,764,406 and 4,718,951 obtained good magnetic properties from material which was continuously cast as slab followed by heating and hot rolling the cast slab prior to the conventional hot rolling step to reduce the size of the columnar grain structure.

Work done in the past, as represented in U.S. Pat. No. 3,333,992 (incorporated herein by reference), added large amounts of sulfur during the early portion of the final high temperature anneal by providing a sulfur-bearing annealing atmosphere or surface coating or both. However, achieving permeabilities at 796 A/m consistently in excess of 1800 required at least two cold reduction stages separated by an annealing step. In the examples of U.S. Pat. No. 3,333,992, a high level of manganese in excess of that required to combine with sulfur and/or selenium from the melt stage was employed.

U.S. Pat. No. 4,493,739 teaches a method for producing regular grain oriented electrical steel using one or two stages of cold rolling. This patent teaches the use of 0.02-0.2% copper in combination with control of the hot mill finishing temperature to improve the uniformity of the magnetic properties. Phosphorus was controlled to less than 0.01% to reduce inclusions. Tin up to 0.10% could be employed to improve core loss of the finished grain oriented electrical steel by reducing the size the (110)[001] grains. The manganese sulfide precipitates were considered to be weak and the uniformity of the magnetic properties were improved by forming fine copper sulfide precipitates to supplement the manganese sulfide inhibitor. During hot rolling, the finish hot strip rolling entrance and exit temperatures were controlled to be from 1000°-1250° C. and 900°-1150° C., respectively. The examples of U.S. Pat. No. 4,493,739 show a conventional two stage cold rolling process was used. While the manganese and copper sulfide precipitates formed after hot rolling were fine and uniformly dispersed, the heavy 60-80% cold reductions required for grain size control and texture development in U.S. Pat. No. 4,493,739 implied that unstable secondary recrystallization would result with a single stage of cold reduction process although no such examples are shown.

U.S. Pat. No. 3,986,902 is related to excess manganese in regular grain oriented electrical steel. The patent uses manganese sulfide for the grain growth inhibitor needed for secondary recrystallization. To be effective, these inhibitors must be finely dispersed to prevent grain boundary migration and grain growth during primary recrystallization and promote grain growth of the (110)[001] grains during secondary recrystallization. Hot working causes these precipitates to grow appreciably and to be concentrated intergranularly such that the precipitates are less effective as grain growth inhibitors. It is therefore essential that the precipitates be dissolved in solid solution and that they precipitate as finely dispersed particles during or after the final step of hot rolling to band. Prior art practices discussed in this patent reviewed the need to provide a silicon steel with 0.07–0.11% manganese and 0.02–0.4% sulfur to provide the necessary grain growth inhibitors (0.055–0.11% manganese sulfide). Manganese in excess of that required to combine with sulfur to form manganese sulfide was present. The excess manganese was desired to prevent hot shortness; however, the patent taught that higher excess manganese decreased the solubility product of manganese sulfide and required higher slab or ingot reheating temperatures since the manganese sulfide was more difficult to dissolve. The patent sought to lower reheating temperatures to 1250° C. (2290° F.) or less by reducing the solubility product to a maximum of about 0.0012%. To enable effective grain growth inhibition using a smaller amount of manganese sulfide further required lowering the levels of insoluble oxides, such as $Al_2O_3$, MnO, $FeSiO_3$, etc., in the steel. It was believed that the oxides had very low solubility in solid steel, particularly at the lower reheating temperatures desired by this invention. Sulfur also had a tendency to react with the oxide inclusions and form oxysulfides, negatively influencing the solubility limits and affecting the development of the desired cube-on-edge orientation. The oxide inclusions noted in U.S. Pat. No. 3,986,902 were incurred during melting and teeming.

Various prior art attempts have been made to reduce the oxygen content to minimize such inclusions such as U.S. Pat. No. 3,802,937 which used lower amounts of manganese sulfide while minimizing oxide nucleation, particularly through the use of protection of the pouring stream during the teeming to avoid reoxidation products. The patent required that the manganese sulfide solubility product be maintained at less than 0.0012% and preferably from 0.0007–0.0010%. This was accomplished, for example, by using 0.05% manganese and 0.02% sulfur. Reducing either sulfur, manganese or both served to provide a lower solubility product; however, since the sulfur must be removed in the final anneal, it was preferred to keep sulfur low and maintain a controlled level of manganese. This resulted in a process having about 0.07–0.08% manganese and about 0.011–0.015% sulfur, the excess manganese content insuring that all of the sulfur was combined as manganese sulfide. As previously mentioned, control of the reoxidation products enabled using lower levels of manganese and sulfur with the lower slab reheating temperatures. Lower manganese-to-sulfur ratios of about 1.7 could be used while avoiding hot brittleness as compared with previous practices in the art which required ratios of about 3.0 . Per the teachings of U.S. Pat. No. 3,802,937, the slabs were reheated to a temperature of less than 1260° C. (2300° F.) and hot rolled to 1.3–2.5 mm (0.05–0.10 inch) thickness before the temperature falls to between 790°–950° C. (1450°–1750° F.). After hot rolling, the steel is cooled to between 450°–560° C. (850°–1050° F.) prior to coiling. Annealing of the hot rolled bands at a temperature of at least 980° C. (1800° F.) was preferred but optional. The bands were cold reduced to an intermediate thickness, annealed and again cold reduced to a typical final thickness of about 0.28 mm (0.011 inch). The steel was then decarburized at a temperature of 760°–815° C. (1400°–1500° F.) to reduce the carbon to 0.007% or less and provide primary recrystallization and subjected to a final anneal at about 1065°–1175° C. (1950°–2150° F.) to effect secondary recrystallization. The one example used 0.031% carbon, 0.055% manganese, 0.006% phosphorus, 0.02% sulfur, 2.97% silicon, 0.002% aluminum, 0.005% nitrogen and balance iron.

As pointed out by the above patents, the control of the manganese sulfide precipitates and the various processing steps required for producing regular grain oriented electrical steel having uniform and consistent magnetic properties is difficult. The ability to obtain the desired properties using a single cold reduction process is even more difficult and it is this challenge to which the present invention is directed.

SUMMARY OF THE INVENTION

The production of regular grain oriented electrical steel requires the control of chemistry and many processing steps to provide the desired magnetic properties. In the following discussions of the present invention, the regular grain oriented electrical steel compositions are in weight percent (%).

The process of the present invention may be used to produce regular grain oriented electrical steel in a wide range of final thicknesses. A typical, but not limiting, process using the features of the present invention for producing material having a final gage of about 0.345 mm (0.0136 inch) could include providing a continuously cast slab having a manganese content of about 0.045–0.060%, a sulfur and/or selenium content of 0.015–0.40% such that the uncombined manganese content (i.e., manganese in excess of that required to combine with sulfur and/or selenium) is 0.024% or less, a carbon content of 0.025% or more and a silicon content of about 3.0–3.5%. Prerolling of the slab is conducted at a temperature of up to 1400° C. (2550° F.) using a reduction of up to 50%. The prerolled slab is further heated to a temperature of 1260°–1400° C. (2300°–2550° F.) and hot rolled to a 1.6–1.8 mm (0.063–0.072 inch) thick band. The band is annealed at about 980°–1065° C. (1800°–1950° F.) for a time of less than 3 minutes followed by cooling to a temperature below 650° C. (1200° F.) where water spray quenching is performed at about 565°–650° C. (1050°–1200° F.) to bring the strip to about room temperature. The composition of the annealed band must provide an austenite volume fraction measured at a reference temperature of 1150° C. (2100° F.), hereinafter referred to as $\gamma_{1150° C.}$, of at least 7% and preferably at least 10%. After initial annealing, the band is then cold rolled in a single step to the final product thickness. The cold rolled strip is then decarburized at a temperature of about 840° C. (1550° F.) in a wet $H_2$ or $H_2$-$N_2$ atmosphere to a level at which magnetic aging will not occur, typically 0.005% or less. The surface of the decarburized strip is provided with an annealing separator coating, typically magnesium oxide, having a weight of about 12 gm/m$^2$ (0.04 ounces/ft$^2$) containing at least 0.20% by weight of sulfur. The addition may be made as sulfur or a sulfur-bearing compound such as Epsom Salts ($MgSO_4.7H_2O$). The strip is then given a final high temperature anneal to develop the (110)[001] grain orientation and magnetic properties by heating in $H_2$ at a rate of about 25° C. (45° F.) per hour to a temperature of about 850° C. (1550° F.) and at about 15° C.

(27° F.) per hour to about 1175° C. (2150° F.). The material is soaked in 100% dry $H_2$ at 1175° C. (2150° F.) for about 15 hours. The finished material made using the single cold reduction process had excellent magnetic properties, typically having permeability measured at H=796 A/m (H=10 Oe) in excess of 1780 and, more typically, in excess of 1820. The measured 60 Hz core losses are typically 1.35 W/kg (0.62 W/lb) or lower at 1.5 T and 1.95 W/kg (0.88 W/lb) or lower at 1.7 T.

It is the object of the present invention to produce regular grain oriented electrical steel having permeability of 1780–1880 measured at 796 A/m using a process which includes a single cold reduction stage.

It is a feature of the present invention that the annealed band is provided with an uncombined manganese content of 0.024% or less in combination with $\partial_{1150° C.}$ of at least 7% to enable use of the single cold reduction process to achieve a uniform and high level of magnetic quality.

It is also a feature of the present invention that the single cold reduction is provided such that the thicknesses of the annealed band and final product are described as:

$$t_o = t_f \exp[(K/t_f)^{0.25}] \quad (1)$$

where $t_0$ is the thickness of the annealed band prior to cold rolling, $t_f$ is the final product thickness and K is a constant having a value of from 2.0 to 2.5. K is related to the intrinsic characteristics of the band, i.e., the qualities of the initial microstructure, texture and grain growth inhibitor(s).

It is a further feature of the present invention that the surface of the decarburized strip is provided with 20–200 mg/m$^2$ of S to enable use of the single cold reduction process to achieve a uniform and high level of magnetic quality.

It is a still further feature of the present invention that the strip is given a final high temperature anneal, typically in coil form, to develop the (110)[001] grain orientation by heating at a rate less than 50° C. (90° F.) per hour in the temperature range from about 700° C. (1300° F.) until secondary grain growth is completed, typically at about 950° C. (1750° F.).

The advantage of the single cold reduction process of the present invention is that the manufacturing time and cost is reduced while equivalent or superior magnetic properties are obtained versus the conventional two stage processes which require an annealing step between two cold rolling stages.

DESCRIPTION OF THE PREFERRED EMBODIMENT

Figure 1:
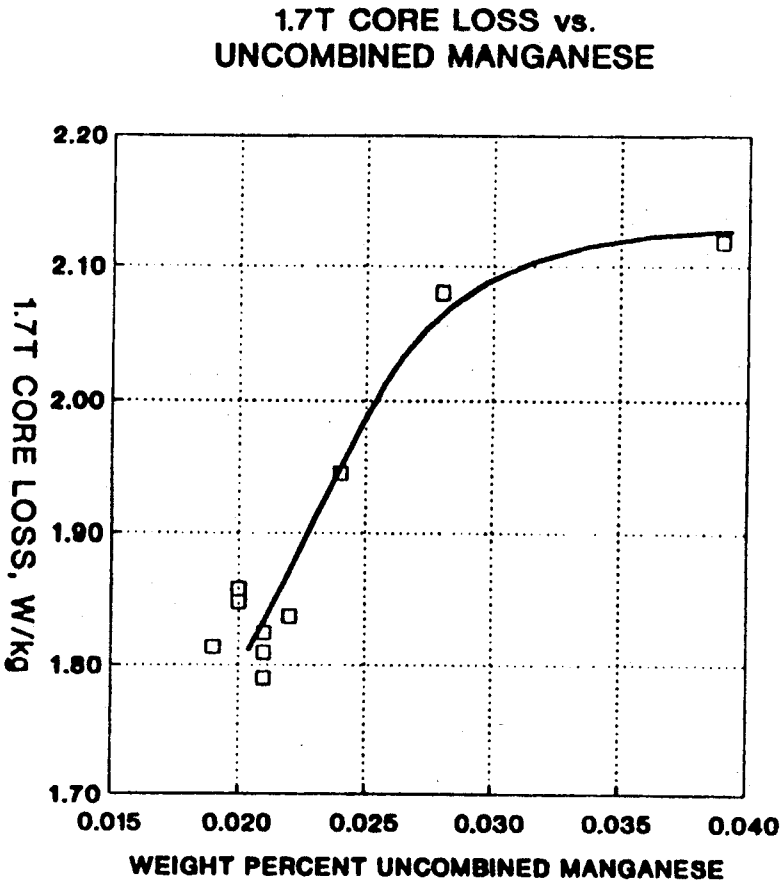
FIG. 1 is a graph exemplifying the relationship between the amount of uncombined manganese and the core loss of the regular grain oriented electrical steel.

In the past, regular grain oriented electrical steels of high quality and uniformity have been produced by processes using two stage cold rolling steps wherein the band is cold reduced to an intermediate thickness, annealed and further cold reduced to the final product thickness. The present invention has developed a method to produce a high quality regular grain oriented electrical steel, including the requirements for composition and processing, which enables the use of a single cold reduction step.

Manganese (Mn) will be present in the amount of from 0.01% to 0.10% and preferably of from 0.03% to 0.07%. Control of Mn in excess of the amount not combined with sulfur (S) and/or selenium (Se) is critical in order to obtain stable secondary grain growth and good magnetic quality using the single cold reduction process of the present invention. The level of uncombined Mn is easily determined using the stoichiometric relationship of total Mn versus S and/or Se contents. For example, a material having 0.02% S would react with about 0.035% Mn, leaving the remaining Mn substantially uncombined. Results from experimentation have shown that an uncombined Mn level of 0.024% or less is needed and 0.020% or less is preferred. If conventional methods of steel melting and casting where either ingots or continuous cast slabs are used to produce a starting band for processing in accordance with the practice of the present invention, a lower level of uncombined Mn is advantageous to ease dissolution of the MnS during reheating before hot rolling. The present invention may also employ a starting band which has been produced using methods such as thin slab casting, strip casting or other methods of compact strip production.

The levels of silicon, carbon and other elements must be controlled in order to provide a critical minimum amount of austenite during the anneal preceding the single cold reduction step of the present invention. Sadayori et al. in their publication, "Developments of Grain Oriented Si-Steel Sheets with Low Iron Loss", *Kawasaki Seitetsu Giho*, vol. 21, no. 3, pp. 93–98, 1989, measured the austenite volume fraction of iron containing 3.0–3.6% Si and 0.030–0.065% C at a temperature of 1150° C. (2100° F.). This work provided an equation to calculate the austenite volume fraction at 1150° C. as:

$$\gamma_{1150° C.} = 694(\% C) - 23(\% Si) + 64.8 \quad (2)$$

While Si and C are the primary elements of concern, other elements such as copper, nickel, chromium, tin, phosphorus and the like made as deliberate additions or may be present as impurities from the steelmaking process will also affect the amount of austenite and, if present, must be considered. For the development of the present invention, the amount of austenite has been found to be critical in order to achieve stable secondary grain growth and the desired (110)[001] orientation. The band prior to cold reduction must provide an austenite volume fraction measured at 1150° C. (defined as $\gamma_{1150° C.}$) in excess of 7% and preferably in excess of 10%.

Regular grain oriented electrical steels may have Si content ranging from 2.5 to 4.5%. The Si content is typically about 2.7 to 3.85% and, preferably, about 3.15 to 3.65%. Si is primarily added to improve the core loss by providing higher volume resistivity. In addition, Si promotes the formation and/or stabilization of ferrite and, as such, is one of the major elements which affects the volume fraction of austenite. While higher Si is desired to improve the magnetic quality, its effect must be considered in order to maintain the desired phase balance.

Typically, C and/or additions such as Cu, Ni and the like which promote and/or stabilize austenite, are employed to maintain the phase balance during processing. The amount of C present in the melt is primarily related to the Si content. For example, 0.01% C may be used with lower Si contents and up to about 0.08% C may be used with higher Si contents. At the typical Si level of 3.15–3.65%, the C content is typically between 0.02–0.05%. It may be necessary to provide an excess melt C to compensate for C lost during processing prior to cold rolling. For example, C may be lost during annealing of the band prior to cold rolling due to the atmosphere used. In the development of the present invention, C losses of up to 0.010% were observed after the band was annealed at 950°–1075° C. (1740°–1970° F.) for 15–30 seconds in a highly oxidizing atmosphere. Thus, the C content of the melt was increased to provide the proper phase balance prior to cold reduction. C above that needed for phase balance is unnecessary since the finally cold rolled strip is typically decarburized to prevent magnetic aging.

S and Se are added to combine with Mn to form MnS and/or MnSe precipitates needed for grain growth inhibition. The required S and/or Se level must be adjusted to provide an uncombined Mn level of 0.024% or less and, preferably, 0.020% or less. Thus S, if used alone, will be present in amounts of from 0.006 to 0.06% and, preferably, of from 0.006 to 0.040%. Se, if used alone, will be present in amounts of from 0.006 to 0.14% and, preferably, of from 0.015 to 0.10%. Combinations of S and Se may be used; however, the relative amounts must be adjusted owing to the different atomic weights of S and Se to provide the proper level of uncombined Mn.

The steel may also include other elements such as aluminum, antimony, arsenic, bismuth, chromium, copper, molybdenum, nickel, phosphorus, tin and the like made as deliberate additions or as impurities from steelmaking process which can affect the austenite volume fraction and/or the stability of secondary grain growth.

As Equation (1) shows, the optimum amount of cold reduction is dependent on the product thickness using the single cold reduction process of the present invention. The regular grain oriented electrical steel of the present invention can be produced from bands made by a number of methods. Bands produced by reheating continuous cast slabs or ingots to temperatures of 1260°–1400° C. (2250°–2550° F.) followed by hot rolling to 1.57–1.77 mm (0.062–0.070 inch) thickness have been processed to produce a 0.345 mm (0.0136 inch) thick product. Prior practices for the production of 0.345 mm thick regular grain oriented using a two stage cold rolling method employed bands of 2.0–3.0 mm (0.08–0.12 inch) in thickness. The present invention is also applicable to bands produced by methods wherein slabs from a continuous casting operation or ingots are fed directly to the hot mill without significant heating, or ingots are hot reduced into slabs of sufficient temperature to hot roll to band without further heating, or by casting the molten metal directly into a band suitable for further processing. In some instances, equipment capabilities may be inadequate to provide the appropriate band thickness needed for the practice of the present invention; however, a small cold reduction of 30% or less may be employed prior to the band anneal or the band may be hot reduced by up to 50% a more appropriate thickness.

Regular grain oriented electrical steels of 0.345 mm final thickness have been manufactured in the plant using the single cold reduction process of the present invention. Laboratory studies have successfully produced regular oriented electrical steels having final thicknesses of from 0.45 mm (0.0176 inch) to 0.27 mm (0.0106 inch). It has been determined that a wide range of final thicknesses can be produced provided that the proper cold reductions are employed. Equation (1) can be used to determine the thickness of the annealed band ($t_o$) based on the relationships between the cold reduction and final product ($t_f$) determined in laboratory studies.

$$t_o = t_f \exp[(K/t_f)^{0.25}] \quad (1)$$

where $t_o$ is the thickness of the annealed band prior to cold rolling, $t_f$ is the final product thickness and K is a constant having a value of from 2.0 to 2.5. K is related to the intrinsic characteristics of the band, i.e., the qualities of the initial microstructure, texture and grain growth inhibitor(s). The value of K can be determined by one skilled in the art by routine experimentation wherein the magnetic properties, particularly the quality of the (110)[001] orientation, are determined by cold reducing bands to samples of various final thicknesses. The intrinsic qualities of the band used in the development of the present invention, as defined within the preferred embodiments for composition and processing, provided a value of K about 2.3. The optimum magnetic properties achieved at the standard product thicknesses of 0.45 mm (0.0176 inch), 0.345 mm (0.0136 inch), 0.295 mm (0.0116 inch) and 0.260 mm (0.0102 inch) in these studies determined that the optimum band thicknesses after annealing were 1.95–2.08 mm (0.078–0.082 inch), 1.65–1.78 mm (0.065–0.070 inch), 1.52–1.65 mm (0.060–0.065 inch) and 1.45–1.57 mm (0.057–0.062 inch) for each respective final product thickness. The production of still lighter thicknesses such as 0.23 mm (0.0082 inch), 0.18 mm (0.0071 inch) and 0.15 mm (0.0058 inch) regular grain oriented may be achieved using bands of the appropriate thickness. Based on the experimental results used to develop Equation (1), the band thicknesses for each respective final thickness are 1.25–1.40 mm (0.049–0.055 inch), 1.15–1.27 mm (0.045–0.050 inch) and 1.00–1.15 mm (0.040–0.045 inch). Such thicknesses may be outside the capabilities of some conventional hot strip mills; however, a cold reduction of 30% or less may be employed prior to the band anneal or the band may be hot reduced by up to 50% to provide a band of the appropriate thickness suitable for the single cold reduction process of the present invention.

In the practice of the present invention, the band is annealed at 900°–1125° C. (1650°–2050° F.) and preferably at 980°–1080° C. (1800°–1975° F.) for a time of up to 10 minutes (preferably less than 1 minute) to provide the desired microstructure prior to the single cold reduction step. During the anneal, a sufficient volume fraction of austenite must be provided to control grain growth. Carbon loss may occur before or during annealing and, if so, the melt composition must be adjusted to maintain the desired phase balance. During the investigations of the present invention, it was observed that the C loss increased as the temperature of the anneal was increased. For example, the typical C lost during annealing at 950° C. (1750° F.) in a highly oxidizing atmosphere was 0.005%; increasing the annealing temperature to 1065° C. (1950° F.) resulted in a 0.0075% C loss. The amount of C lost will vary with the band thickness and the atmosphere, time and temperature of annealing. The process of cooling after annealing is important since control of the austenite decomposition process is desired. During cooling, some austenite decomposition into C-saturated ferrite is desired in order to provide fine carbide precipitates and/or C in solution to enhance the (110)[001] texture. Other desirable austenite decomposition products include a small amount of martensite and pearlite. In order to provide the desired microstructural features, slow cooling to 480°-650° C. (900°-1200° F.) is desired to provide for austenite decomposition; rapid cooling, such as water spray quenching, from a temperature of 480°-650° C. to 100° C. (212° F.) or less is preferred to provide martensite, fine carbide precipitates and/or solute C.

S and/or Se is provided in the melt in order to form the manganese sulfide and/or selenide grain growth inhibitor(s). In addition, a small amount of S must be provided to the sheet surface during the final high temperature annealing step in order to obtain the desired (110)[001] grain orientation. Providing a grain growth inhibitor in the environment, as taught in U.S. Pat. No. 3,333,992 (incorporated herein by reference), allows additions of inhibitors such as S and Se to the steel from the annealing separator coating and/or atmosphere. This allows for greater flexibility in the melt composition and manganese sulfide/selenide precipitation during hot rolling while enabling attainment of the desired magnetic properties. The practice of U.S. Pat. No. 3,333,992 provided for S added as various forms, including sulfur, ferrous sulfide and other compounds, which dissociate or decompose during the final high temperature anneal prior to secondary grain growth. It was believed that the S-bearing additive formed hydrogen sulfide gas in the final anneal which reacted with the steel to form sulfides at the grain boundaries. The S-bearing addition prevented the primary grains from becoming too large to be consumed during secondary grain growth. The amount of the S-bearing addition was dictated by the minimum amount required to retard grain growth and the maximum amount which was found to not interfere with realizing the desired magnetic properties. The lowest amount of excess or uncombined Mn level based on the melt compositions taught in U.S. Pat. No. 3,333,992 was 0.0265%.

In the practice of the present invention, it is critical to provide S to the surface of the steel sheet during the final high temperature anneal. The S is typically provided by the magnesium oxide separator coating which is applied after cold rolling and prior to the final high temperature anneal. Typically, the separator coating is applied at a weight of about 2 to 10 gm/m$^2$/side (0.005-0.035 oz/ft$^2$/side) on both sheet surfaces which provides a total coating weight of 4-20 gm/m$^2$ (0.01-0.07 oz/ft$^2$). The magnetic quality was strongly affected by the total S provided by the coating. It has been found that a total S level of at least 20 mg/m$^2$ is required to establish and maintain stable secondary grain growth; acceptable magnetic properties have been obtained at levels as high as 250 mg/m$^2$. Sulfur-bearing additions may be made in many forms, such as sulfur, sulfuric acid, hydrogen sulfide or as a S-bearing compound such as sulfates, sulfites and the like. Se-bearing additions may be employed in combination with or as a substitute for S; however, the greater health and environmental hazards of Se must be considered. It was found in the development of the present invention that uncombined Mn levels greater than 0.024% would not produce stable secondary growth even when the appropriate S addition was made to the annealing separator coating.

After cold reduction to final thickness is completed, conventional decarburization is required to reduce the C level to an amount which avoids magnetic aging, typically less than 0.003% C. In addition, the decarburization anneal prepares the steel for the formation of a forsterite, or "mill glass", coating in the high temperature final anneal by reaction of the surface oxide skin and the annealing separator coating. It was determined that ultra-rapid annealing as part of the decarburizing process as taught in U.S. Pat. No. 4,898,626 may be used to increase productivity, but no magnetic quality gains were observed.

The final high temperature anneal is needed to develop the (110)[001] grain orientation or "Goss" texture. Typically, the steel is heated to a soak temperature of at least about 1100° C. (2010° F.) in a $H_2$ atmosphere. During heating, the (110)[001] nuclei begin the process of secondary grain growth at a temperature of about 850° C. (1575° F.) and which is substantially completed by about 980° C. (1800° F.). Typical annealing conditions used in the practice of the present invention employed heating rates of up to 50° C. (90° F.) per hour up to about 815° C. (1500° F.) and further heating at rates of about 50° C. (90° F.) per hour, and, preferably, 25° C. (45° F.) per hour or lower up to the completion of secondary grain grwoth at about 980° C. (1800° F.). Once secondary grain growth is complete, the heating rate is not as critical and may be increased until the desired soak temperature is attained wherein the material is held for a time of at least 5 hours (preferably at least 20 hours) for removal of the S and/or Se inhibitors and for removal of impurities as is well known in the art.

A series of heats were melted and processed in the plant in accordance with the practice of the present invention. The melt composition of the heats shown in Table I provided uncombined Mn ranging from 0.0188% to 0.0388%.

TABLE I

SUMMARY OF HEAT COMPOSITIONS (WEIGHT PERCENT)

| | Heat Designation | | | | | | | | | |
|---|---|---|---|---|---|---|---|---|---|---|
| % | A | B | C | D | E | F | G | H | I | J |
| C | .0356 | .0356 | .0350 | .0352 | .0359 | .0349 | .0356 | .0351 | .0353 | .0346 |
| N | .0047 | .0042 | .0037 | .0039 | .0035 | .0056 | .0039 | .0033 | .0033 | .0035 |
| S | .0218 | .0215 | .0223 | .0212 | .0212 | .0214 | .0210 | .0202 | .0223 | .0205 |
| Mn | .0561 | .0572 | .0586 | .0575 | .0576 | .0580 | .0578 | .0590 | .0660 | .0739 |

TABLE I-continued

| SUMMARY OF HEAT COMPOSITIONS (WEIGHT PERCENT) | | | | | | | | | | |
|---|---|---|---|---|---|---|---|---|---|---|
| | Heat Designation | | | | | | | | | |
| % | A | B | C | D | E | F | G | H | I | J |
| Cu | .060 | .056 | .101 | .088 | .088 | .111 | .096 | .111 | .104 | .085 |
| Si | 3.086 | 3.164 | 3.148 | 3.169 | 3.143 | 3.176 | 3.135 | 3.117 | 3.175 | 3.228 |

Figure 2:
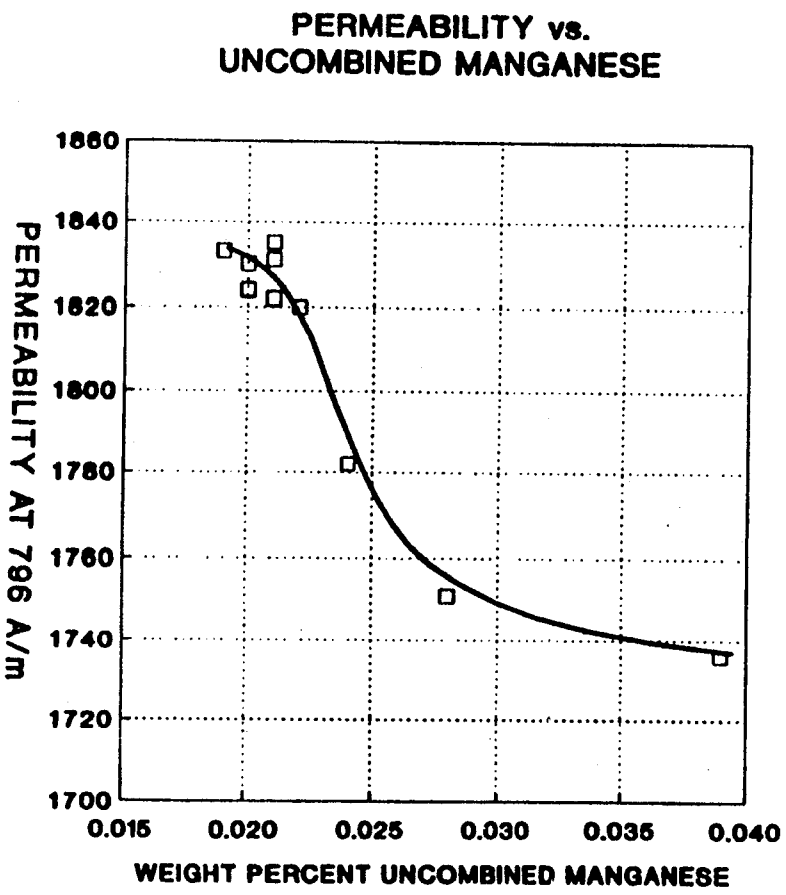
FIG. 2 is a graph exemplifying the relationship between the amount of uncombined manganese and the permeability of the regular grain oriented electrical steel.

All of the above heat chemistries include a balance of iron and normal residual elements. Levels of other elements include Al of 0.002% or less, B of 0.0005% or less, Cr of 0.16% or less, Mo of 0.040% or less, Ni of 0.15% or less, P of less than 0.010% or less, Sn of 0.015% or less, Sb of 0.0015% or less and Ti of 0.002% or less. The heats were continuously cast into 200 mm (8 inch) thick slabs, heated to about 1150° C. (2100° F.), prerolled to 150 mm (6 inch) thick slabs, heated to about 1400° C. (2550° F.) and rolled to 1.57–1.65 mm (0.062–0.065 inch) thick bands. The bands were annealed in an oxidizing atmosphere at 1025°–1065° C. (1875°–1950° F.) for 15–30 seconds, air cooled to 580°–650° C. (1075°–1200° F.) and water spray quenched to a temperature below 100° C. (212° F.). Based on the melt composition and C lost during annealing, the volume fraction of austenite ($\gamma_{1150° C.}$) was from 10 to 14% as per the preferred practice of the present invention. The annealed bands were reduced on a three-stand tandem cold mill to 0.345 mm (0.0136 inch) thickness and decarburized at about 840° C. (1550° F.) in a wet $H_2$-$N_2$ atmosphere. The decarburized sheets were coated with a MgO slurry containing $MgSO_4.7(H_2O)$ to provide a dried annealing separator coating weighing 6 gm/m2 on each sheet surface which further provided 16 mg/m2 of S on each sheet surface. Thus the total weight of the dried coating was 12 gm/m$^2$ which provided a total of 32 mg/m$^2$ of S. The coated sheet was final annealed in coil form by heating in $H_2$ at a rate of about 30° C./hr (55° F./hr) up to 750° C. (1380° F.) and about 15° C./hr (35° F./hr) to 1175° C. (2150° F.) and holding at 1175° C. (2150° F.) for at least 15 hours. The permeabilities measured at 796 A/m and core losses measured at 1.5 and 1.7 T are shown in Table II and FIGS. 1 and 2 show the degradation of the magnetic properties for Heats H, I and J which had uncombined Mn levels exceeding 0.024%. While Heat H provided an average permeability of 1782, the results represent the average of over 25 coils, many tests from which were below 1780. As these results show, regular grain oriented steel produced by a single cold reduction process requires the uncombined Mn be controlled to a level of 0.024% or less to provide consistent magnetic quality.

TABLE II

| MAGNETIC PROPERTIES VERSUS EXCESS Mn 60 Hz CORE LOSS AND PERMEABILITY AT 796 A/m | | | | | | | | | | |
|---|---|---|---|---|---|---|---|---|---|---|
| | Heat Designation | | | | | | | | | |
| | Steels of the Present Invention | | | | | | | Steels not of the Present Invention | | |
| | A | B | C | D | E | F | G | H | I | J |
| Excess Mn | .0188 | .0204 | .0204 | .0212 | .0213 | .0213 | .0218 | .0244 | .0278 | .0388 |
| 1.5 T (W/kg) | .590 | .593 | .595 | .576 | .580 | .582 | .588 | .605 | .637 | .650 |
| (W/lb) | 1.30 | 1.31 | 1.31 | 1.27 | 1.28 | 1.28 | 1.30 | 1.33 | 1.40 | 1.43 |
| 1.7 T (W/kg) | .823 | .839 | .844 | .812 | .821 | .828 | .834 | .882 | .944 | .961 |
| (W/lb) | 1.81 | 1.85 | 1.86 | 1.79 | 1.81 | 1.83 | 1.84 | 1.94 | 2.08 | 2.12 |
| Permeability | 1833 | 1830 | 1824 | 1835 | 1831 | 1822 | 1820 | 1782 | 1751 | 1736 |

Additional Heats K, L, M and N (Table III) were melted and processed in the plant to a final thickness of 0.345 mm as per the heats of the previous example. These heats, along with Heats A through G of the previous example, provided an uncombined Mn level within the preferred practice of the present invention. The levels of the elements (not reported in Table III) were similar to the heats of the first example (Table I); however, the compositions of Heats K, L, M and N were varied to provide $\gamma_{1150° C.}$ of from about 8% to about 10%.

TABLE III

| SUMMARY OF HEAT COMPOSITIONS (WEIGHT PERCENT) | | | | | | | | | | | |
|---|---|---|---|---|---|---|---|---|---|---|---|
| | Heats of Previous Example (Preferred Range of Present Invention) | | | | | | | Heats of Present Example (Broad Range) | | | |
| % | A | B | C | D | E | F | G | K | L | M | N |
| C | .0356 | .0356 | .0350 | .0352 | .0359 | .0349 | .0356 | .0318 | .0312 | .0310 | .0384 |
| N | .0047 | .0042 | .0037 | .0039 | .0035 | .0056 | .0039 | .0042 | .0034 | .0038 | .0044 |
| S | .0218 | .0215 | .0223 | .0212 | .0212 | .0214 | .0210 | .0229 | .0214 | .0215 | .0220 |
| Mn | .0561 | .0572 | .0586 | .0575 | .0576 | .0580 | .0578 | .0575 | .0580 | .0576 | .0586 |
| Cu | .060 | .056 | .101 | .088 | .088 | .111 | .096 | .082 | .080 | .088 | .090 |
| Si | 3.086 | 3.164 | 3.148 | 3.169 | 3.143 | 3.176 | 3.135 | 3.150 | 3.153 | 3.177 | 3.466 |

Figure 4:
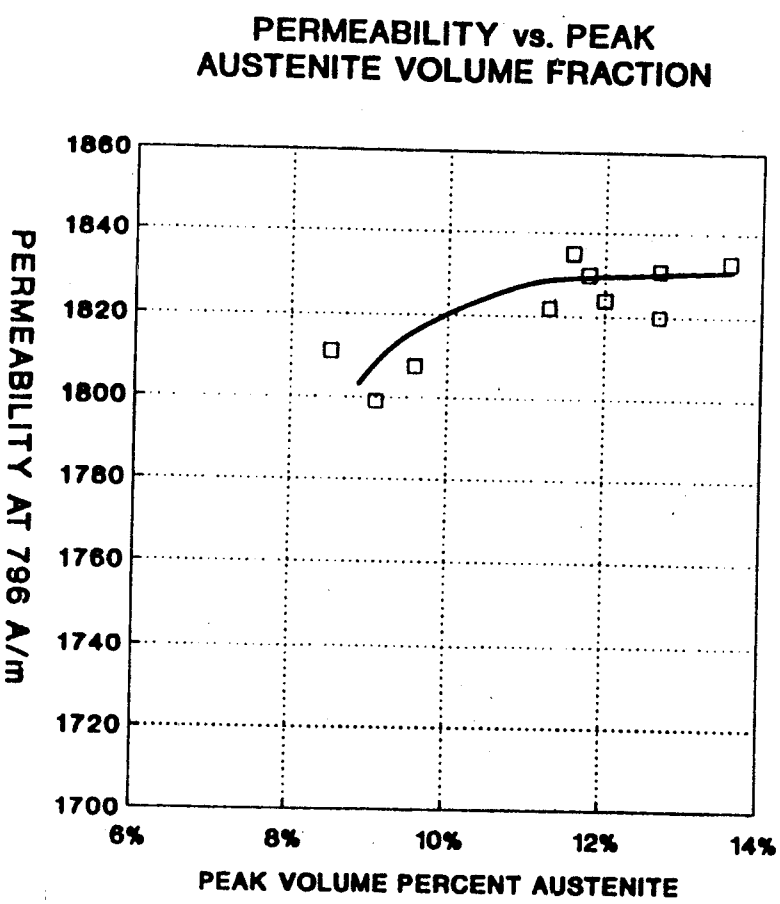
FIG. 4 is a graph exemplifying the relationship between the amount of peak volume austenite and the permeability of the regular grain oriented electrical steel.
Figure 3:
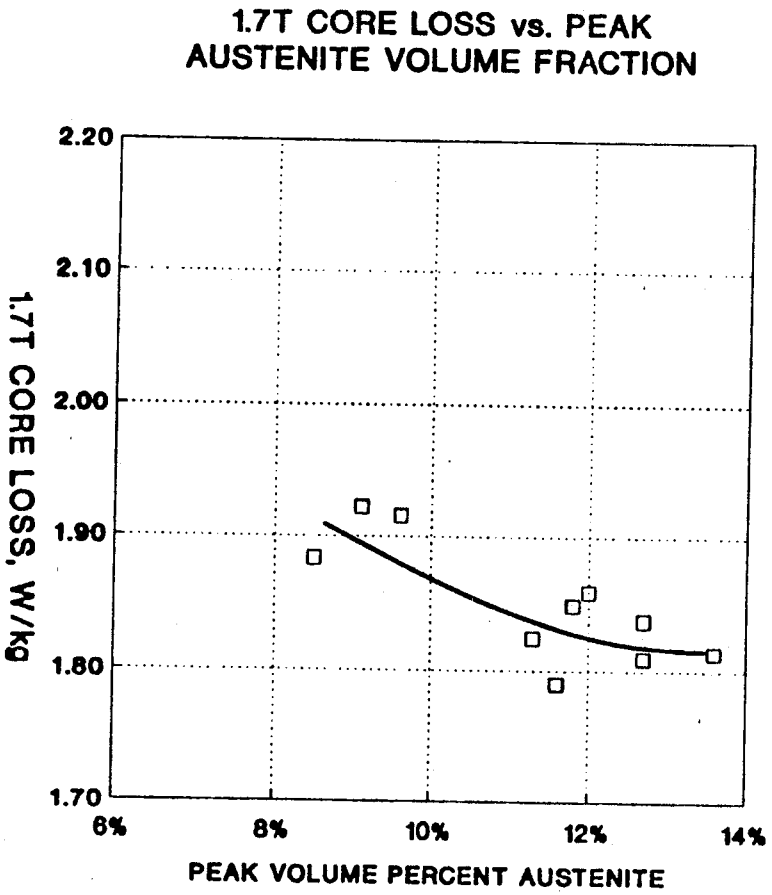
FIG. 3 is a graph exemplifying the relationship between the amount of peak volume austenite and the core loss of the regular grain oriented electrical steel.

Table IV and FIGS. 3 and 4 show that Heats K, L M and N provided satisfactory and consistent magnetic properties as $\gamma_{1150° C.}$ is maintained above the minimum level of 7%. Heats A through G show that maintaining the austenite volume fraction above the preferred minimum of 10% provided excellent magnetic properties, typically providing permeabilities measured at 796 A/m exceeding 1820 and 1.7 60 Hz core losses of about 1.85 W/kg (0.84 W/lb) at 1.7 T or lower.

TABLE IV

MAGNETIC PROPERTIES VERSUS AUSTENITE VOLUME FRACTION 60 Hz CORE LOSS AND PERMEABILITY AT 796 A/m

| | Preferred Minimum Range of Invention | | | | | | | Broad Minimum Range of Invention | | | |
|---|---|---|---|---|---|---|---|---|---|---|---|
| Heat | A | B | C | D | E | F | G | K | L | M | N |
| $\gamma_{1150°}$ C. (%) | 13.6 | 11.8 | 12.0 | 11.6 | 12.7 | 11.3 | 12.7 | 9.6 | 9.1 | 8.5 | 8.0 |
| 1.5 T (W/lb) | .590 | .593 | .595 | .576 | .580 | .582 | .588 | .604 | .604 | .596 | .571 |
| (W/kg) | 1.30 | 1.31 | 1.31 | 1.27 | 1.28 | 1.28 | 1.30 | 1.33 | 1.33 | 1.31 | 1.26 |
| 1.7 T (W/lb) | .823 | .839 | .844 | .812 | .821 | .828 | .834 | .869 | .872 | .855 | .818 |
| (W/kg) | 1.81 | 1.85 | 1.86 | 1.79 | 1.81 | 1.83 | 1.84 | 1.92 | 1.92 | 1.88 | 1.80 |
| Permeability | 1833 | 1830 | 1824 | 1835 | 1831 | 1822 | 1820 | 1808 | 1799 | 1811 | 1811 |

Figure 6:
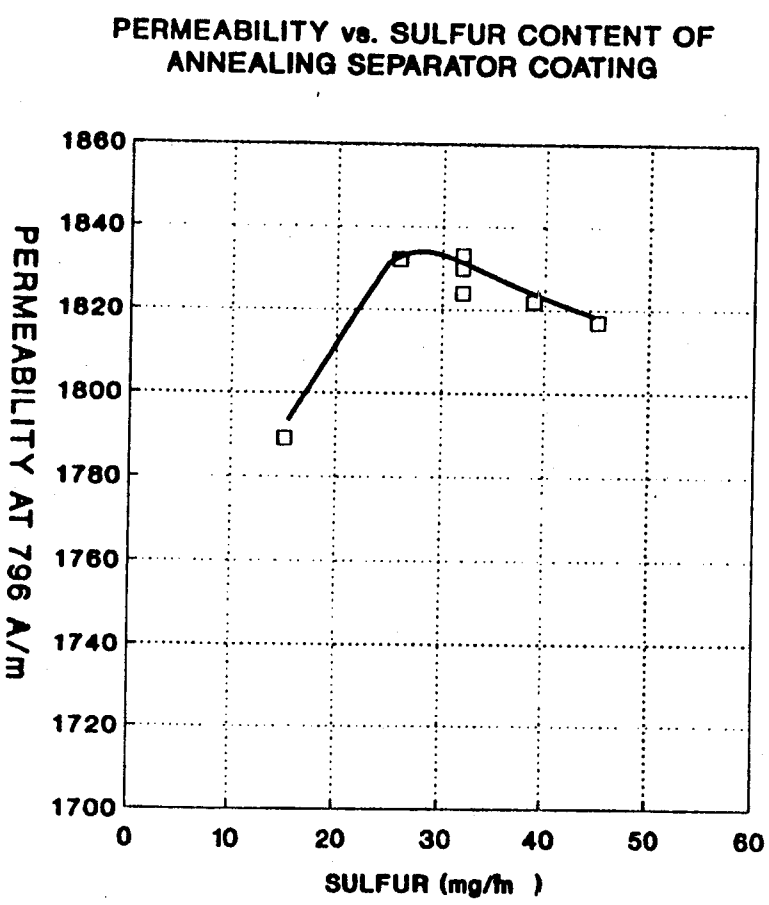
FIG. 6 is a graph exemplifying the relationship between the amount of sulfur in the annealing separator coating and the permeability of the regular grain oriented electrical steel.
Figure 5:
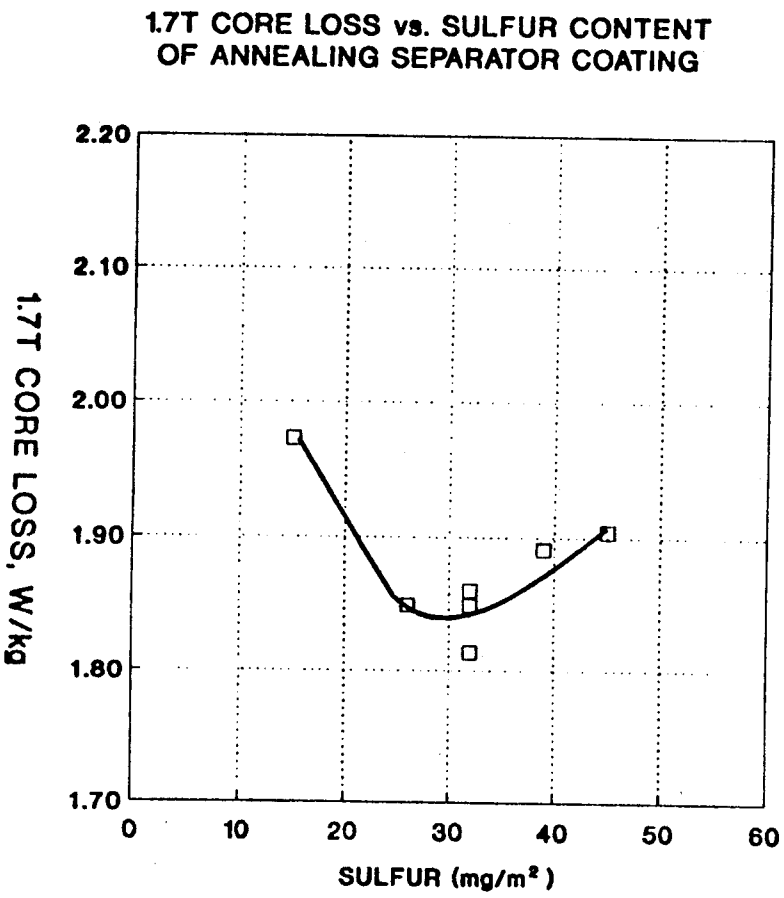
FIG. 5 is a graph exemplifying the relationship between the amount of sulfur in the annealing separator coating and the core loss of the regular grain oriented electrical steel.

During plant experimentation, the composition of the annealing separator coating for the heats melted and processed to a final thickness of 0.345 mm in accordance with the practice of the present invention was varied to determine the S requirements at the strip surface. The Mn, S, C and Si contents of each heat in this experiment provided an uncombined Mn level of 0.024% or less and an austenite volume fraction of the annealed band of more than 10%. The decarburized sheets were coated with a MgO slurry containing $MgSO_4.7(H_2O)$ to provide a dried annealing separator coating weighing 6 gm/m$^2$ on each sheet surface thus providing a total coating weight of 12 gm/m$^2$ and a total S content of 15–45 mg/m$^2$. Table V and FIGS. 5 and 6 show that acceptable magnetic quality was obtained when the total S provided by the coating was at least 15 mg/m$^2$. However, providing a total S level above 20 mg/m$^2$ in accordance with the preferred practice of the present invention produced excellent magnetic properties with permeabilities measured at 796 A/m typically exceeding 1810 and 60 Hz core losses of about 1.90 W/kg (0.86 W/lb) or lower at 1.7 T.

TABLE V

SUMMARY OF RESULTS

| Heat | % Austenite Before Anneal | % Austenite After Anneal | % Excess Mn | Total S MgO Separator Coating mg/m$^2$ | Core Loss 1.5 T 60 Hz W/lb | Core Loss 1.5 T 60 Hz W/kg | Core Loss 1.7 T 60 Hz W/lb | Core Loss 1.7 T 60 Hz W/kg | Permeability @ 796 A/m |
|---|---|---|---|---|---|---|---|---|---|
| O | 16.5% | 11.3% | .0186 | 15 | .612 | 1.35 | .895 | 1.97 | 1789 |
| C | 17.2% | 12.0% | .0204 | 32 | .594 | 1.31 | .844 | 1.86 | 1824 |
| C | 17.2% | 12.0% | .0204 | 39 | .600 | 1.32 | .858 | 1.89 | 1822 |
| C | 17.2% | 12.0% | .0204 | 45 | .606 | 1.34 | .864 | 1.90 | 1817 |
| A | 18.8% | 13.6% | .0188 | 32 | .590 | 1.30 | .830 | 1.83 | 1833 |
| B | 17.0% | 11.8% | .0204 | 26 | .592 | 1.31 | .836 | 1.84 | 1832 |
| B | 17.0% | 11.8% | .0204 | 32 | .593 | 1.31 | .839 | 1.85 | 1830 |

The preferred embodiment discussed hereinabove has demonstrated that a single stage cold reduction process in combination with the other processing steps of the present invention does provide a consistent and excellent level of magnetic quality which compares favorably with the conventional 2-stage cold reduction processes of the prior art.

The invention as described hereinabove in the context of a preferred embodiment is not to be taken as limited to all of the provided details thereof, since modifications and variations thereof may be made without departing from the spirit and scope of the invention.

What is claimed is:

1. A method for producing regular grain oriented electrical steel having a permeability measured at 796 A/m of from 1780 to 1880, said method comprising the steps of:

a) providing a band which consists essentially of, in weight percent, 2.5–4.5% Si, 0.01–0.08% C, 0.009% or less Al, 0.006 to 0.06% S, 0.006–0.14% Se, 0.01–0.10% Mn with a maximum of 0.024% in excess of that needed to combine with S and/or Se, and balance being essentially iron and normally occurring residual elements;

b) providing said band having a thickness of:

$$t_o = t_f \exp[(K/t_f)^{0.25}]$$

where $t_o$ is the thickness of the band prior to cold rolling to final thickness, $t_f$ is the final product thickness and K being a constant having a value of from 2.0 to 2.5;

c) annealing said band at a temperature of from 900°–1125° C. (1650°–2050° F.) for a time up to 10 minutes;

d) providing $\gamma_{1150°\,C.}$ in said annealed band of at least 7%;

e) cold rolling said annealed band in a single stage to final strip thickness;

f) decarburizing said strip to a level sufficient to prevent magnetic aging;

g) providing a S-bearing addition onto one or more surfaces of said strip such that the total S provided to the said strip is at least 15 mg per square meter;

h) providing said strip with an annealing separator coating;

i) final annealing said coated strip at a temperature of at least 1100° C. (2010° F.) for at least 5 hours to effect secondary grain growth and thereby develop said permeability:

2. The method claimed in claim 1 wherein said annealed band is provided with slow cooling to a temperature of 480°–650° C. (900°–1200° F.) followed by rapid cooling to a temperature below 100° C. (212° F.).

3. The method claimed in claim 1 wherein said final annealing includes the step of heating said regular grain oriented electrical steel at a rate not exceeding 50° C./hr (90° F./hr) up to 1100° C. (2010° F.).

4. The method claimed in claim 1 wherein said Mn in excess of that needed to combine with S and/or Se is maintained at a level below about 0.020%.

5. The method claimed in claim 1 wherein said austenite volume fraction in said annealed band is at least 10%.

6. The method claimed in claim 1 wherein said Mn is from 0.03–0.07% and said S is from 0.006–0.040%.

7. The method claimed in claim 1 wherein said C is from 0.02–0.05% and said Si is from 2.70–3.85%.

8. The method claimed in claim 1 wherein said band is annealed at 980°–1080° C. (1800°–1975° F.) for one minute or less.

9. The method claimed in claim 1 wherein said annealing separator coating is applied at a weight of 2–10 grams per square meter (0.005–0.035 ounces per square foot) on said strip surface and said annealing separator.

10. The method claimed in claim 1 wherein said total S is provided from said annealing separator coating on one or more surfaces of said strip such that the total S provided to the said strip is at least 20 mg per square meter.

11. The method claimed in claim 1 wherein said band is cold reduced by up to 30% to a suitable thickness prior to said anneal.

12. The method claimed in claim 1 wherein said band is hot reduced by up to 50% during said anneal to provide said annealed band of suitable thickness.

13. A method for producing regular grain oriented electrical steel having a permeability measured at 796 A/m of at least 1780 comprising the steps of:

a) providing a band having a thickness of from 1.0–2.1 mm, said band consisting essentially of, in weight percent, 2.5–4.5% Si, 0.01–0.08% C, 0.009% or less Al, 0.006 to 0.06% S, 0.006–0.14% Se, 0.01–0.10% Mn with a maximum of 0.024% in excess of that needed to combine with S and/or Se, and balance being essentially iron and normally occurring residual elements, b) annealing said band at a temperature of from 900°–1125° C. (1650°–2050° F.) for a time up to 10 minutes, said annealed band having $\gamma_{1150° C.}$ of at least 7%;

c) cold rolling said annealed band in a single stage by a reduction of greater than 75 to 90% to final gauge strip;

d) decarburizing said strip to a level sufficient to prevent magnetic aging;

e) providing a S-bearing addition onto one or more surfaces of said strip such that the total S provided to said strip is at least 15 mg per square meter;

f) providing said strip with an annealing separator coating; and g) final annealing said coated strip for a time and temperature sufficient to develop secondary recrystallization and provide a permeability at 10 oersteds of at least 1780.

* * * * *